United States Patent [19]

Olson

[11] Patent Number: 4,944,277

[45] Date of Patent: Jul. 31, 1990

[54] CYLINDER ENTRAPMENT SYSTEM WITH AN AIR SPRING

[75] Inventor: Jeffrey A. Olson, Mundelein, Ill.

[73] Assignee: Outboard Marine Corporation, Waukegan, Ill.

[21] Appl. No.: 318,708

[22] Filed: Mar. 3, 1989

[51] Int. Cl.[5] ..... F02M 67/04

[52] U.S. Cl. ..... 123/532; 123/316

[58] Field of Search ..... 123/531, 532, 533, 534, 123/316

[56] References Cited

U.S. PATENT DOCUMENTS

| | | | |
|---|---|---|---|
| 2,164,511 | 7/1939 | Furlong | 236/1 E |
| 2,387,862 | 10/1945 | Smith et al. | 123/434 |
| 4,771,754 | 9/1988 | Reinke | 123/532 X |
| 4,865,002 | 9/1989 | Borst et al. | 123/532 |

*Primary Examiner*—Tony M. Argenbright

*Attorney, Agent, or Firm*—Michael, Best, & Friedrich

[57] ABSTRACT

The invention provides an internal combustion engine comprising a cylinder, a piston reciprocal in the cylinder, an accumulation chamber, a supply conduit including a check valve and extending between the cylinder and the accumulation chamber, a supply valve having a valve head located between the cylinder and the check valve and operable between an open position and a closed position to control gas flow from the cylinder through the supply conduit to the accumulation chamber, and an arrangement responsive to the pressure in the accumulation chamber and in the cylinder for selectively moving the supply valve relative to the open position and the closed position.

14 Claims, 2 Drawing Sheets

CYLINDER ENTRAPMENT SYSTEM WITH AN AIR SPRING

BACKGROUND OF THE INVENTION

The invention relates generally to internal combustion engines. More particularly, the invention relates to systems for accumulating compressed gas from a cylinder of an internal combustion engine.

The invention also relates to arrangements for creating a source of compressed gas which can be mixed with fuel and injected into a spark ignited internal combustion engine.

Attention is directed to the following United States Patents:

| U.S. Pat. No. | Issue Date |
|---|---|
| 2,164,511 | July 4, 1939 |
| 2,387,862 | October 30, 1945 |

Attention is also directed to U.S. patent application Ser. No. 159,661, filed Feb. 24, 1988, now U.S. Pat. No. 4,865,002.

SUMMARY OF THE INVENTION

The invention provides an internal combustion engine comprising a cylinder, a piston reciprocal in the cylinder, an accumulation chamber, a supply conduit including a check valve and extending between the cylinder and the accumulation chamber, a supply valve having a valve head located between the cylinder and the check valve and operable between an open position and a closed position to control gas flow from the cylinder through the supply conduit to the accumulation chamber, and means responsive to the pressure in the accumulation chamber and in the cylinder for selectively moving the supply valve relative to the open position and the closed position.

In one embodiment of the invention, the means responsive to the pressure in the accumulation chamber includes a secondary chamber, a passage extending from the accumulation chamber to the secondary chamber and including means for restrictively supplying gas from the accumulation chamber to the secondary chamber at a rate lower than the rate at which gas is supplied to the accumulation chamber from the cylinder, a bore extending between the secondary chamber and the supply conduit at a location between the cylinder and the check valve, and a diaphragm defining a wall of the secondary chamber to prevent gas flow through the bore between the supply conduit and the secondary chamber and connected to the supply valve so that the diaphragm disposes the supply valve to the open position in the absence of a pressure differential across the diaphragm of a predetermined value, whereby the supply valve permits gas flow from the cylinder into the accumulation chamber during increasing cylinder pressure, during each piston upstroke, until cylinder pressure exceeds the pressure in the secondary chamber by the predetermined value to close the supply valve.

One embodiment of the invention provides an internal combustion engine comprising a cylinder, a piston reciprocal in the cylinder, an accumulation chamber, a supply conduit including a check valve and extending between the cylinder and the accumulation chamber, a supply valve having a valve head located between the cylinder and the check valve and operable between an open position and a closed position to control gas flow from the cylinder through the supply conduit to the accumulation chamber, a secondary chamber, a passage extending from the accumulation chamber to the secondary chamber and including means for restrictively supplying gas from the accumulation chamber to the secondary chamber at a rate lower than the rate at which gas is supplied to the accumulation chamber from the cylinder, a bore extending between the secondary chamber and the supply conduit at a location between the cylinder and the check valve, and a diaphragm defining a wall of the secondary chamber to prevent ga flow through the bore between the supply conduit and the secondary chamber and connected to the supply valve so that the diaphragm disposes the supply valve to the open position in the absence of a pressure differential across the diaphragm of a predetermined value, whereby the supply valve permits gas flow from the cylinder into the accumulation chamber during increasing cylinder pressure, during each piston upstroke, until cylinder pressure exceeds the pressure in the secondary chamber by the predetermined value to close the supply valve.

In one embodiment of the invention, an internal combustion engine is provided including a cylinder, a piston reciprocal in the cylinder, an accumulation chamber, a supply conduit including a check valve and extending between the cylinder and the accumulation chamber, a supply valve having a valve head located between the cylinder and the check valve and operable in the supply conduit between an open position and a closed position to control gas flow from the cylinder through the supply conduit to the accumulation chamber, means responsive to the pressure in the accumulation chamber and in the cylinder for selectively moving the supply valve relative to the open position and the closed position, discharge conduit and valve means communicating between the accumulation chamber and the cylinder and operative to selectively mix pressure gas from the accumulation chamber with fuel under pressure and to discharge the resultant fuel/gas mixture into the cylinder, and means adapted to communicate with a source of fuel and operative to supply fuel under pressure to the discharge conduit and valve means at a pressure sufficient to effect operation of the discharge and conduit valve means to mix pressure gas from the accumulation chamber with fuel under pressure and discharge the resultant fuel/gas mixture into the cylinder.

Other features and advantages of the invention will become apparent to those skilled in the art upon review of the following detailed description, claims, and drawings.

Figure 1:
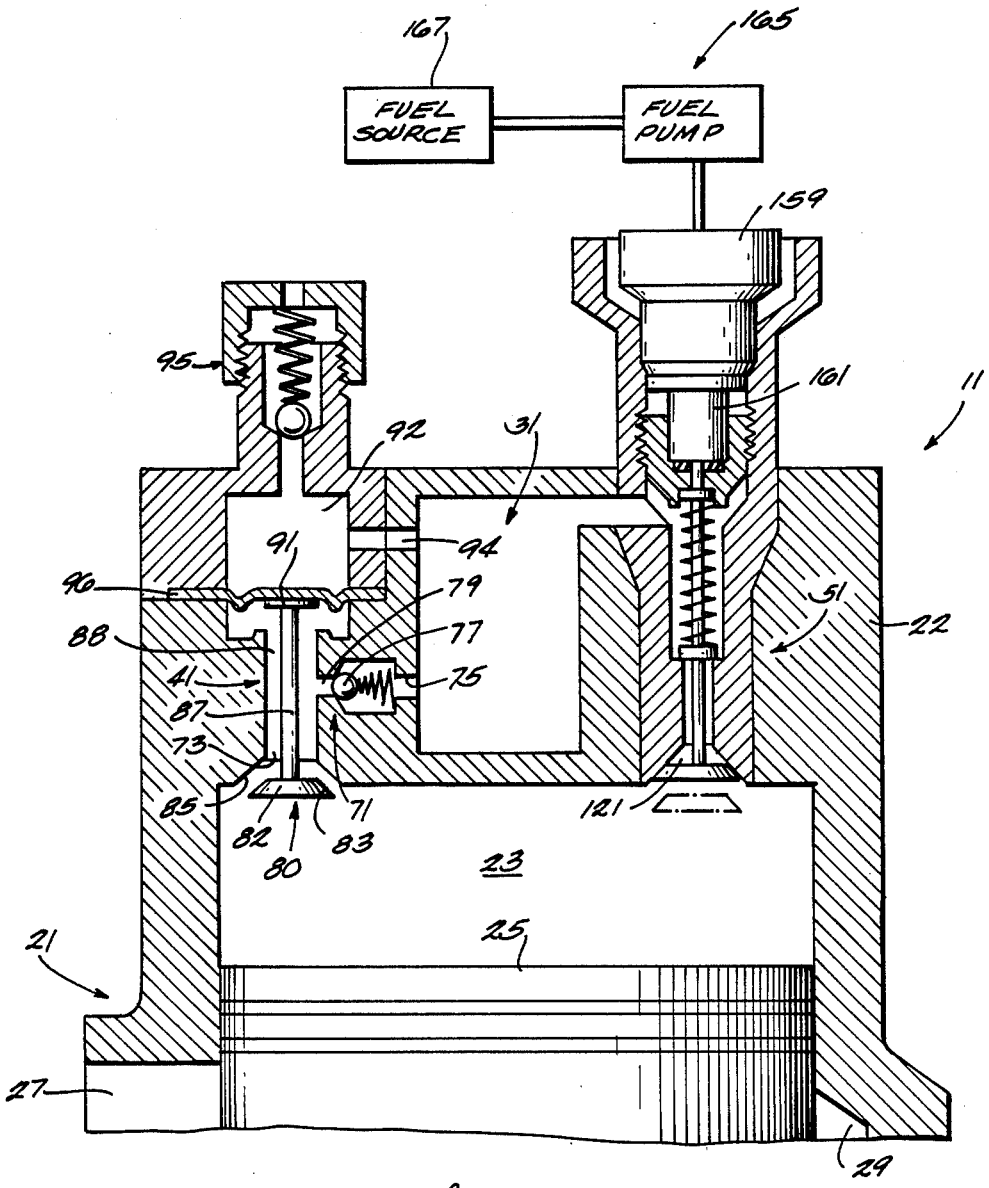
FIG. 1 is a fragmentary and diagramatic view of an internal combustion engine including a fuel supply system incorporating various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

Shown in FIG. 1 is a fuel supply system 11 for an internal combustion engine 21, preferably a two-stroke engine, which engine 21 includes an engine block or head 22 defining a cylinder 23, and a piston 25 moveable in the cylinder 23 relative to a top dead center position so as to vary the pressure in the cylinder 23 in a manner well known in the art.

The cylinder 23 also includes an exhaust port 27 and an inlet or transfer port 29 through which air is supplied to the cylinder 23, preferably from a crankcase (not shown) in the usual fashion.

The fuel supply system 11 includes means defining an accumulation chamber or plenum 31 for gas which is retained under pressure and which is supplied from the cylinder 23. Because it is contemplated that the cylinder 23 will be normally supplied with air through the inlet port 29, the gas which is supplied to the accumulation chamber 31 is pressurized and, at least in large part, is air.

The accumulation chamber 31 can take various forms and preferably is formed, at least in part, in the engine block or head 22 which also defines the cylinder 23.

The fuel supply system 11 also includes discharge conduit and valve means 51 communicating between the accumulation chamber 31 and the cylinder 23, for discharging to the cylinder 23 a fuel/gas mixture.

Further, the fuel supply system 11 includes means 61 for spraying or supplying fuel, such as liquid gasoline, under pressure, to the discharge conduit and valve means 51 to therebY mix pressure gas from the accumulation chamber 31 with fuel under pressure and to discharge the resultant fuel/gas mixture into the cylinder 23.

The fuel supply system 11 also includes supply means 41 communicating with the accumulation chamber 31 and with the cylinder 23 for supplying gas to the accumulation chamber 31 in response to piston reciprocation.

The supply means 41 comprises a supply conduit 71 which extends between the head end of the cylinder 23 and the accumulation chamber 31 and which includes a first branch conduit or segment 73 having a first end communicating with the cylinder 23 and an opposite end, together with a second branch conduit or segment 75 which includes a first end communicating wit the first branch conduit 73 between the ends thereof, and a second end communicating with the accumulation chamber 31. Included in the second branch conduit 75 is a check valve 77 permitting flow to the accumulation chamber 31 and preventing flow from the accumulation chamber 31. Any suitable check valve construction can be employed.

The supply means 41 also comprises a pressure actuated supply valve 80 including a valve head 82 which, in the construction disclosed in FIG. 1, is conical and which is movable, in response to valve member movement, between open and closed positions relative to a valve seat 85 which, in the construction shown in FIG. 1, is also conical and which is formed in the first branch conduit 73 adjacent to the cylinder 23.

The supply means 41 also includes means responsive to the Pressure in the accumulation chamber 31 and in the cylinder 23 for selectively moving the valve 80 relative to the open and closed positions. This means comprises a secondary chamber 92 and a gas flow impeding passage 94 extending from the accumulation chamber 31 to the secondary chamber 92, which passage allows gas to flow from the accumulation chamber 31 to the secondary chamber 92 at a rate much lower than the rate at which gas can be supplied to the accumulation chamber 31 from the cylinder 23.

The moving means further includes means for selectively regulating the pressure in the secondary chamber 92. More particularly, an adjustable pressure regulating valve 95 communicates between the secondary chamber 92 and the atmosphere.

Further, the moving means includes a bore 88 extending from the secondary chamber 92 to the first branch conduit 73. Also included in the responsive means is a metal diaphragm 96 which defines a wall of the secondary chamber 92 and which prevents gas flow through the bore 88 and between the cylinder 23 an the secondary chamber 92 above the diaphragm 96. The supply valve 80, which was previously discussed, further includes a valve stem 87 which has an outer head 91, attached to the diaphragm 96, and which extends through the bore 88 to the valve head 82.

In an unpressurized system, the main valve 80 is disposed in the open position. Upon pressurization, after a few reciprocations of the piston 25 in the cylinder 23, the supply valve 80 operates to permit gas flow from the cylinder 23 into the accumulation chamber 31 upon increasing cylinder pressure, during each piston upstroke, until cylinder pressure exceeds the pressure in the secondary chamber 92 by a predetermined value, at which time the pressure applied acts to close the supply valve 80. In the absence of a pressure differential of the predetermined value, during each piston downstroke, the main valve 80 returns to the open position.

The pressure in the secondary chamber 92 is regulated by the setting of the adjustable pressure regulating valve 95. Since the secondary chamber 92 is connected to the accumulation chamber 31 solely by a gas flow impeding passage, only a relatively small amount of gas is lost to the atmosphere through the pressure regulating valve 95. An advantage of using a secondary chamber, such as the secondary chamber 92 to act on a metal diaphragm to bias a main valve, as opposed to having a heavy spring act on an elastomeric diaphragm to bias a main valve, is improved diaphragm life. The maximum pressure differential across the diaphragm is low and is, for example, 10 or 15 psig, resulting in reduced stress on the diaphragm.

When the supply valve 80 is in the fully open position, the valve head 82 is spaced from the valve seat 85 at a distance sufficiently large so that flow into the first branch conduit 73 from the cylinder 23 is unobstructed and so that cylinder pressure acts on the diaphragm 96. Increasing pressure in the cylinder 23 and in the first branch conduit 73 acts to upwardly displace the diaphragm 96 and the connected outer head 91 against the pressure in the secondary chamber 92. Such upward movement of the outer head 91 advances the valve surface 83 toward the valve seat 85 and, when the preselected pressure differential is present across the diaphragm 96, causes closure of the supply valve 80.

In operation of the construction shown in FIG. 1, movement of the piston 25 toward top dead center position compresses the gas in the cylinder 23 (primarily air introduced through the inlet port 29). Such compressed gas flows through the first and second branch conduits 73 and 75, past the check valve 77, and into the accumulation chamber 31 when the valve surface 83 is spaced from the valve seat 85. As the piston 25 moves upwardly, a point is reached where the cylinder pressure acting against the diaphragm 96 is high enough to close the pressure actuated supply valve 80 against the pressure in the secondary chamber 92. Such valve closure is designed to occur before commencement of combustion in the cylinder 23. After closure of the supply valve 80, the increasing pressure in the cylinder 23 keeps the supply valve 80 closed, while the combustion process proceeds normally, before the piston 25 begins its downstroke.

The diaphragm 96 requires a certain pressure differential across it in order to move through its intended stroke. For example, it may take 10 psi across the diaphragm in order for it to move 0.030" to close the supply valve 80. Also, the secondary chamber 92 may be regulated at 40 psig, for example. In such a case, the theoretical cylinder pressure required to close the supply valve would be $40\ psig + 10\ psi = 50 psig$. If no gas was withdrawn from the accumulation chamber 30, besides the small flow to the secondary chamber 92, the accumulation chamber would reach approximately 50 psig. By varying the setting of the pressure regulating valve 95, this pressure can be changed. When starting with a completely discharged accumulation chamber 31 (0 psig), a few reciprocations of piston 25 in the cylinder 23 are required for pressurization of the accumulation chamber.

If the accumulation chamber 31 is of such large volume as to dilute or reduce the pressure in the first branch conduit 73 below the pressure in the cylinder 23 prior to closure of the supply valve 80, it is desirable to provide the second branch conduit 75 with a flow restriction or orifice 79 which can be located, as shown in FIG. 1, between the check valve 77 and the first branch conduit 73. If the accumulation chamber is sufficiently small that loss of pressure in the cylinder 23 would not become significant, the orifice or restriction 79 can be enlarged.

The supply means 41 serves to accumulate in the accumulation chamber 31 a body of gas (at least mostly air) in response to piston reciprocation. In addition, the volume of the accumulation chamber 31, as compared to the volume of gas used at each fuel injection, is sufficiently large so that the gas pressure is approximately constant under operating conditions. Since the supply valve 80 closes on each cycle before combustion occurs, and does not open until after the piston begins its downstroke, the gas trapped in the accumulation chamber 31 is relatively clean. In addition, the amount of gas supplied to the accumulation chamber 31, during each cycle, is relatively small, but is greater than the gas discharged from the accumulation chamber 31 each cycle during initial pressurization, and is at least as large as the gas discharged from the accumulation chamber 31 after it becomes pressurized.

Various means operative to supply fuel under pressure to the discharge conduit and valve means 51 at a pressure sufficient to effect operation thereof to mix pressure gas from the accumulation chamber 31 with fuel under pressure and to discharge the resultant mixture into the cylinder can be employed. In the disclosed construction, such means comprises a fuel injector 159 which includes a nozzle 161 and which is preferably electrically operated to discharge, at a given time and for a given period, pressure fuel into a branch conduit 121. Any suitable construction for the fuel injector 159 construction can be employed. It is preferred that the fuel injector 159 be solenoid operated, as is known in the art, and that the fuel injector 159 communicate through a suitable fuel supply conduit 163 with the outlet of a fuel pump 165 which is adapted to be connected to a suitable fuel source 167 and which is capable of providing fuel under suitable pressure. Any suitable fuel pump construction can be employed.

The discharge conduit and valve means 51 shown in FIG. 1 is more particularly described in U.S. patent application Ser. No. 159,661, filed Feb. 24, 1988, now U.S. Pat. No. 4,865,002, the specification of which is incorporated herein by reference.

Figure 2:
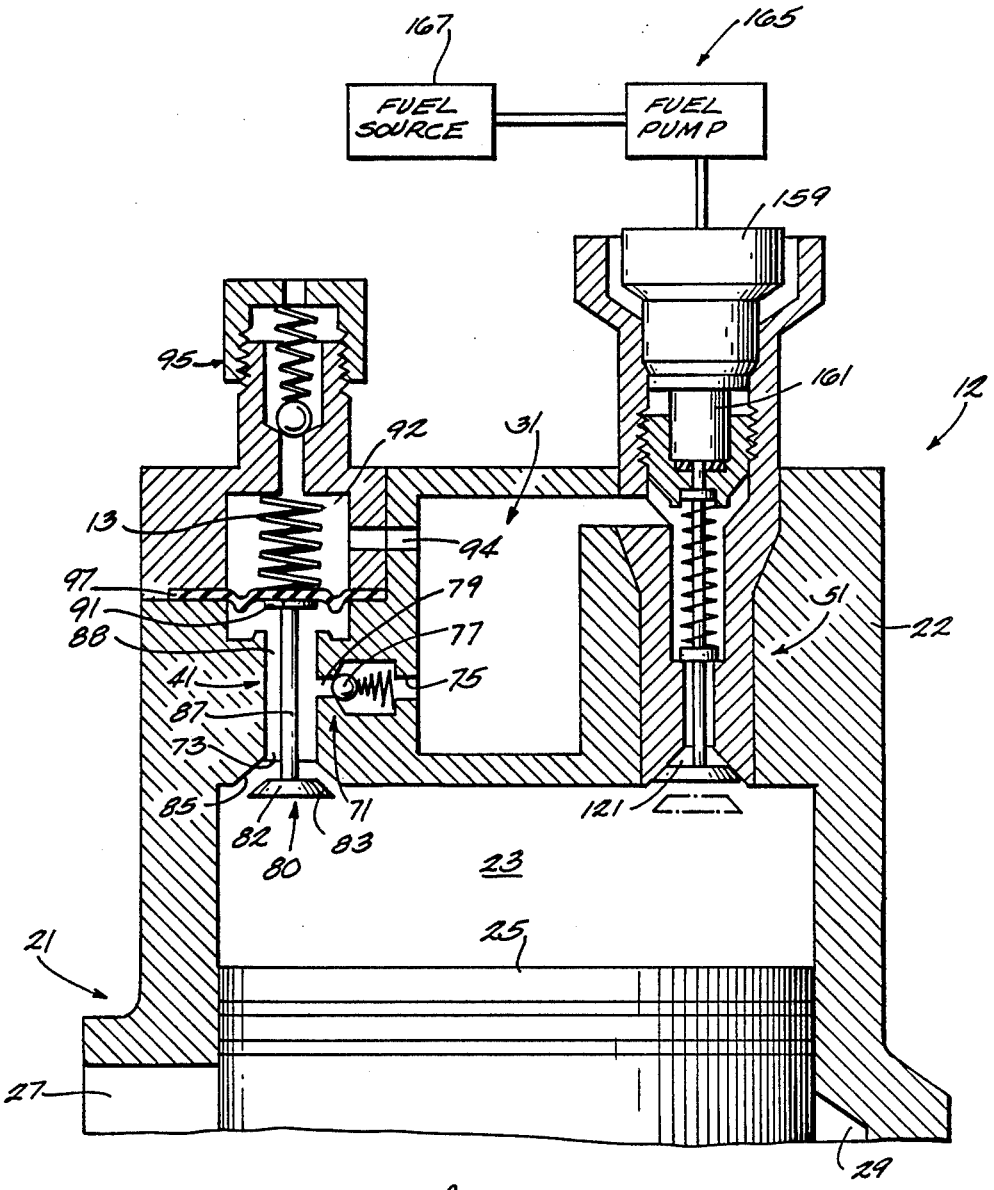
FIG. 2 is a fragmentary and diagramatic view of an internal combustion engine including an alternate fuel supply system incorporating various of the features of the invention.

An alternate fuel supply system 12 is shown in FIG. 2. The fuel supply system 12 is substantially identical to the fuel supply 11, except that a light spring 13 is included in the secondary chamber 92, and an elastomeric diaphragm 97 is used instead of the metal diaphragm 96. The light spring 13 acts with the air pressure in the secondary chamber 92 to bias the main valve 80 to the open position, and the advantage of low maximum pressure differential across the diaphragm is maintained.

Various of the features of the invention are set forth in the following claims.

What is claimed:

1. An internal combustion engine comprising a cylinder, a piston reciprocal in said cylinder, an accumulation chamber, a supply conduit including a check valve and extending between said cylinder and said accumulation chamber, a supply valve having a valve head located between said cylinder and said check valve and operable between an open position and a closed position to control gas flow from said cylinder through said supply conduit to said accumulation chamber, and means responsive to the pressure in said cylinder and responsive to the pressure in said accumulation chamber acting in by-passing relation to said check valve for selectively moving said supply valve relative to said open position and said closed position.

2. An internal combustion engine comprising a cylinder, a piston reciprocal in said cylinder, an accumulation chamber, a supply conduit including a check valve and extending between said cylinder and said accumulation chamber, a supply valve having a valve head located between said cylinder and said check valve and operable between an open position and a closed position to control gas flow from said cylinder through said supply conduit to said accumulation chamber, and means responsive to the pressure in said accumulation chamber and in said cylinder for selectively moving said supply valve relative to said open position and said closed position, said means for moving said supply valve comprising a secondary chamber, a passage extending from said accumulation chamber to said secondary chamber and including means for restrictively supplying gas from said accumulation chamber to said secondary chamber at a rate lower than the rate at which gas is supplied to said accumulation chamber from said cylinder, a bore extending between said secondary chamber and said supply conduit at a location between said cylinder and said check valve, and a diaphragm defining a wall of said secondary chamber to prevent gas flow through said bore between said supply conduit and said secondary chamber and connected to said supply valve so that said diaphragm disposes said supply valve to the open position in the absence of a pressure differential across said diaphragm of a predetermined value, whereby said supply valve permits gas flow from said cylinder into said accumulation chamber during increasing cylinder pressure, during each piston upstroke, until cylinder pressure exceeds the pressure in said secondary chamber by the predetermined value to close said supply valve.

3. An internal combustion engine in accordance with claim 2 wherein said diaphragm is a metal diaphragm.

4. An internal combustion engine in accordance with claim 2 wherein said diaphragm is an elastomeric diaphragm, and wherein said means for moving said supply valve further includes a spring located in said secondary chamber and oriented against said diaphragm to bias said main valve towards the open position.

5. An internal combustion engine in accordance with claim 2 further comprising means for regulating the pressure in said secondary chamber.

6. An internal combustion engine in accordance with claim 5 wherein said means for regulating the pressure in said secondary chamber comprises a pressure regulating valve.

7. An internal combustion engine in accordance with claim 2 wherein said means for restrictively supplying gas comprises an orifice.

8. An internal combustion engine comprising a cylinder, a piston reciprocal in said cylinder, an accumulation chamber, a supply conduit including a check valve and extending between said cylinder and said accumulation chamber, a supply valve having a valve head located between said cylinder and said check valve and operable between an open position and a closed position to control gas flow from said cylinder through said supply conduit to said accumulation chamber, a secondary chamber, a passage extending from said accumulation chamber to said secondary chamber and including means for restrictively supplying gas from said accumulation chamber to said secondary chamber at a rate lower than the rate at which gas is supplied to said accumulation chamber from said cylinder, a bore extending between said secondary chamber and said supply conduit at a location between said cylinder and said check valve, and a diaphragm defining a wall of the secondary chamber to prevent gas flow through said bore between said supply conduit and said secondary chamber and connected to said supply valve so that said diaphragm disposes said supply valve to the open position in the absence of a pressure differential across said diaphragm of a predetermined value, whereby said supply valve permits gas flow from said cylinder into said accumulation chamber during increasing cylinder pressure, during each piston upstroke, until cylinder pressure exceeds the pressure in said secondary chamber by the predetermined value to close said supply valve.

9. An internal combustion engine in accordance with claim 8 wherein said diaphragm is a metal diaphragm.

10. An internal combustion engine in accordance with claim 8 wherein said diaphragm is an elastomeric diaphragm, and further including a spring located in said secondary chamber and oriented against said diaphragm to bias said main valve towards the open position.

11. An internal combustion engine in accordance with claim 8 and further including discharge conduit and valve means for supplying a mixture of liquid fuel and gas to said cylinder, and an exit passageway from said accumulation chamber to said fuel system to provide gas to said fuel system.

12. An internal combustion engine in accordance with claim 8 and further including means for regulating the pressure in said secondary chamber.

13. An internal combustion engine in accordance with claim 12 wherein said means for regulating the pressure in said secondary chamber comprises an adjustable pressure regulating valve.

14. An internal combustion engine comprising a cylinder, a piston reciprocal in said cylinder, an accumulation chamber, a supply conduit including a check valve and extending between said cylinder and said accumulation chamber, a valve having a valve head located between said cylinder and said check valve and operable in said supply conduit between an open position and a closed position to control gas flow from said cylinder through said supply conduit to said accumulation chamber, means responsive to the pressure in said cylinder and responsive to the pressure in said accumulation chamber acting in by-passing relation to said check valve for selectively moving said supply valve relative to said open position and said closed position, discharge conduit and valve means communicating between said accumulation chamber and said cylinder and operative to selectively mix pressure gas from said accumulation chamber with fuel under pressure and to discharge the resultant fuel/gas mixture into said cylinder, and means adapted to communicate with a source of fuel and operative to supply fuel under pressure to said discharge conduit and valve means at a pressure sufficient to effect operation of said discharge conduit and valve means to mix pressure gas from said accumulation chamber with fuel under pressure and discharge the resultant fuel/gas mixture into said cylinder.

* * * * *